United States Patent [19]

Böhne et al.

[11] Patent Number: 4,833,968

[45] **Date of Patent: * May 30, 1989**

[54] DOUBLE LAYER ARMOR

[75] Inventors: Hans Böhne, Kürten; Artur Butterweck, Hagen-Dahl; Erich Pothe, Horneburg/Stade; Hans-Jürgen Hansohm, Amersbek/Storman, all of Fed. Rep. of Germany

[73] Assignee: Clouth Gummiwerke Aktiengesellschaft, Cologne, Fed. Rep. of Germany

[ * ] Notice: The portion of the term of this patent subsequent to Apr. 19, 2005 has been disclaimed.

[21] Appl. No.: 118,417

[22] Filed: Nov. 6, 1987

Related U.S. Application Data

[63] Continuation of Ser. No. 865,264, May 20, 1986, Pat. No. 4,738,184.

[30] Foreign Application Priority Data

May 24, 1985 [DE] Fed. Rep. of Germany ..... 3518779

[51] Int. Cl.[4] ..... F41H 7/04

[52] U.S. Cl. ..... 89/36.08; 89/36.02

[58] Field of Search ..... 89/36.02, 36.04, 36.07, 89/36.08; 109/81; 114/10, 12, 13, 14

[56] References Cited

U.S. PATENT DOCUMENTS

| | | | |
|---|---|---|---|
| 485,683 | 11/1892 | Clay | 114/13 |
| 1,226,075 | 5/1917 | Ison | 89/36.04 |
| 4,036,104 | 7/1977 | Pagano et al. | 89/36.08 |
| 4,738,184 | 4/1988 | Bohne et al. | 89/36.08 |

FOREIGN PATENT DOCUMENTS

| | | | |
|---|---|---|---|
| 16902 | of 1886 | United Kingdom | 114/10 |
| 7265 | of 1888 | United Kingdom | 89/36.04 |
| 2297 | of 1898 | United Kingdom | 114/13 |

OTHER PUBLICATIONS

The Illustrated Science and Invention Encyclopedia, 1977, p. 2209.

*Primary Examiner*—Stephen C. Bentley
*Attorney, Agent, or Firm*—Herbert Dubno; Andrew Wilford

[57] ABSTRACT

A double layer armor for an armored vehicle. At least two elastic retaining mounts are provided between an inner armor plate member and one of a plurality of sections not attached to each other forming an outer armor plate member. At least one of the elastic retaining mounts is formed as an engagable or disengagable pivot mount, while at least one other elastic retaining mount comprises a housing attached rigidly with the inner armor plate member and a core attached detachably with the respective section of the outer armor plate member as well as an elastic member mounted between the housing and the core.

1 Claim, 3 Drawing Sheets

DOUBLE LAYER ARMOR

This is a continuation of co-pending application Ser. No. 865,264, filed on May 20, 1986, now U.S. Pat. No. 4,738,184.

FIELD OF THE INVENTION

Our present invention relates to a double layer armor and, more particularlyk, to a double layer plate armor for an armored vehicle which can form part of its outer surface.

BACKGROUND OF THE INVENTION

Double layer armor for an armored vehicle can have at least two elastic retaining mounts btween an inner armor plate and a plurality of sections not attached to each other forming the outer aromr plate.

The armor plate of German Pat. No. 23 24 724 has the inner and outer armor plate members attached to each other by elastic retaining mounts. Each retaining mount is attached on one side with a base plate to the inner armor plate member while on its other side a retaining screw penetrates the outer armor plate member and engages in a threaded hole thus holding the outer armor plate member in place.

OBJECTS OF THE INVENTION

It is an object of our invention to provide an improved double layer armor plate member for an object, particularly an armored vehicle.

It is also an object of our invention to provide an improved double layer armor plate member for an object which permits the mounting and demounting of the outer armor plate member in a short time without expensive additional mechanisms.

It is another object of our invention to provide an improved double layer armor plate member for an object which protects the object from reasonably large impact loads while allowing a quick convenient mounting and demounting of the outer armor plate member.

Still another object is to provide an improved armor which is capable of dropping impact projectile energies of about 600 m to about 40 m to with impact angles of 90° to 30° without difficulty.

SUMMARY OF THE INVENTION

These objects and others which will become more readily apparent hereinafter are attained in a double more armor plate member for an armored vehicle having at least two elastec retaining mounts between an inner aromr plate member and each of a plurality of sections not attached to each other forming an outer armor plate member.

According to our invention at least one of the elastic retaining members is an engagable and disengagable pivot mount. At least one other retaining member comprises a housing mounted on the inner armor plate member and a core atteched detachably with the respective section of the outer armor plate member. An elastic member is insertable between the housing and the core to provide a flexible impact absorbing mounting.

Advantageously each of the pivot mounts can comprise two brackets rigidly attached to the inner armor plate member and a pivot upper part rigidly attached with the respective section of the outer armor plate member. The pivot upper part can have a pivot shaft mounted therein elastically by a bushing composed of a flexible material. The brackets can be provided with slots for engagement of the ends of the pivot shaft.

Also the region of the pivot shaft surrounded by the bushing can have the shape of twin truncated cones with coincident bases having the pivot shaft tapered axially toward the exterior form the central region of the pivot shaft.

Furthermore slots provided in the brackets can be positioned on the side of the brackets facing away from the other retaining members.

In a particularly desirable form of our invention the core of the other retaining member is provided with an extending protrusion and the respective section of the outer armor plate member is also provided with another corresponding extending protrusion.

Each of the extending protrusions can be aligned with the other and the extending protrusions can have projecting members corresponding to each other. A rotatable ring has an upper projecting edge directed interiorly on an upper side thereof and another lower projecting edge dirscted inward on an upper side thereof and another lower projecting edge directed inward on a lower side thereof, wherein both projecting edges are provided with radial recesses to form a bayonet connection.

The extending protrusions are so dimensioned that the radial recesses of the ring receive the extending protrusions when the extending protrusions are in place. The spacing of the protruding edges from each other is somewhat larger than the thickness of two of the projections when they are positioned over each other.

The flexibly mounted readily mountable outer armor plate member of our invention provides a cushioned protective barrier to significant large impacts from armor-piercing projectiles, explosions of shells, bombs, and the like. Our invention can withstand an impinging load with impact energies of about 600 m to, dissipating such energies in the shortest exposure times to a residual energy of about 40 m to. These results are for impact angles of between 90° to 30°.

BRIEF DESCRIPTION OF THE DRAWING

The above and other objects, features and advantages of our invention will become more readily apparent from the following description, reference being made to the accompanying drawing in which.

SPECIFIC DECRIPTION

Figure 1:
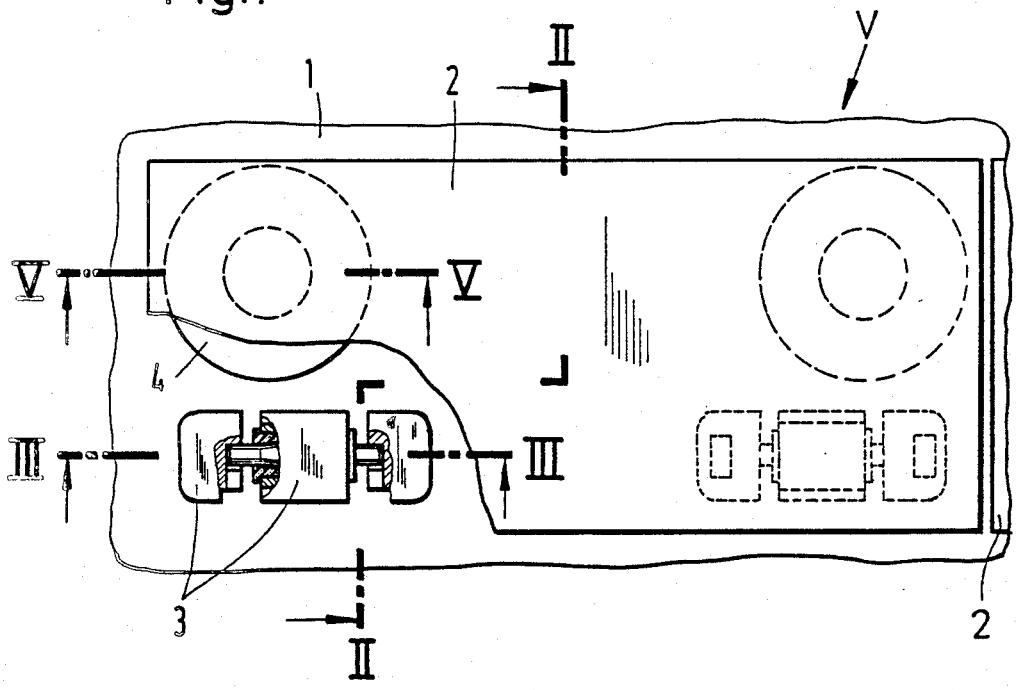
FIG. 1 is a partially cutaway front elevational view of one embodiment of a double layer armor plate member of an object with a section of the outer armor plate nenber broken away to expose one of the pivot mounts.
Figure 2:
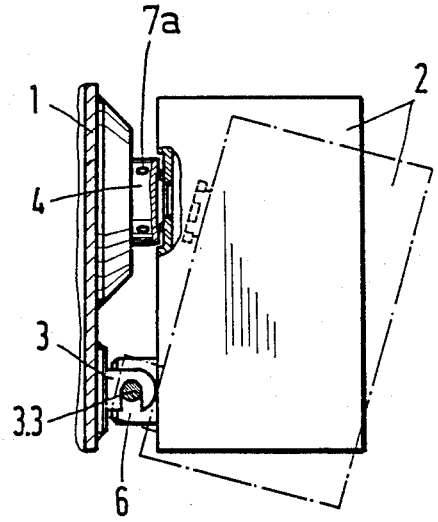
FIG. 2 is a side cross sectional view of the double layer armor plate member of FIG. 1 taken along the section line II—II of FIG. 1.

The double layer armor plate assembly for the armored vehicle V, only a portion of a wall of which has been illustrated, shown in FIGS. 1 and 2 comprises an inner armor plate member 1 and a plurality of sections 2 not attached with each other forming an outer plate member. The sections 2 of the outer plate member are mounted on the inner plated member 1 by two engagable and disengagable pivot mounts 3 and two other elastic retaining members 4.

Figure 3:
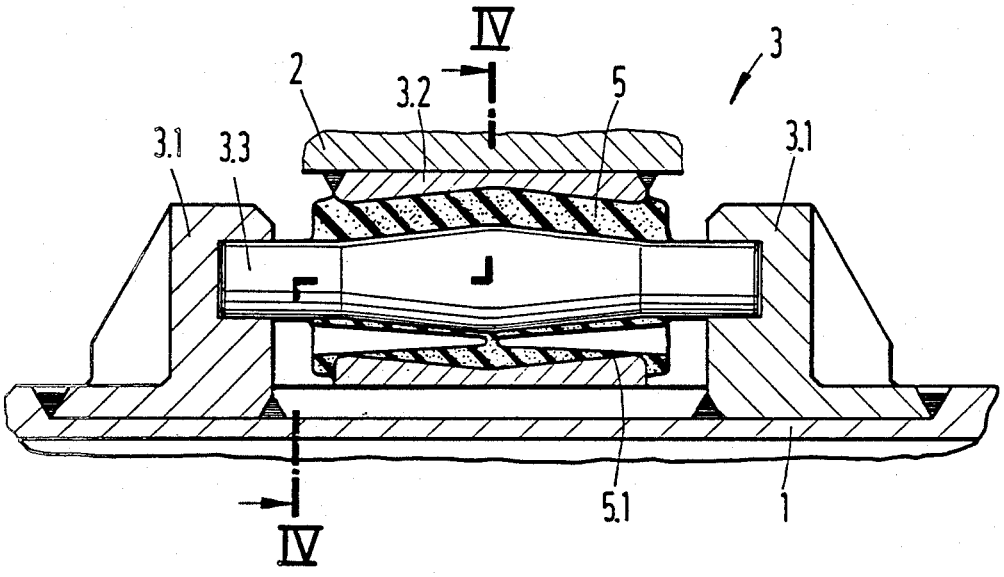
FIG. 3 is a cross sectional view of the pivot mount of the double layer armor plate member of FIG. 1 taken along the section line III—III of FIG. 1.
Figure 4:
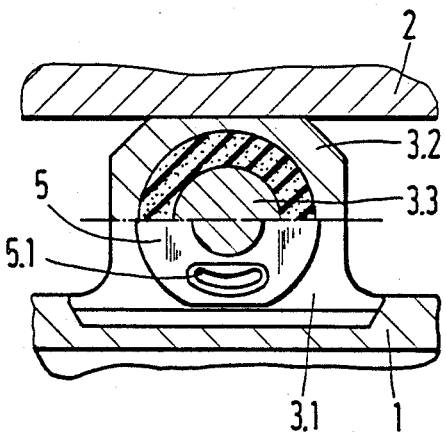
FIG. 4 is another cross sectional view of the pivot mount according to FIG. 3 taken along the section line IV—IV of FIG. 3.

The pivot mount 3 shown in FIGS. 3 and 4 has two brackets 3.1 rigidly attached to the inner armor plate member 1 and a pivot upper part 3.2 rigidly attached to the outer armor plate member 2 as well as a pivot shaft 3.3 pivotally mounted in the brackets 3.1 Between the pivot shaft 3.3 and the pivot upper part 3.2 a bushing 5 composed of a flexible material is provided, which has twin nonaxial slots 5.1. The pivot shaft 3.3 is shaped like twin truncated cones with coincident bases in the region surrounding the bushing 5. Both cones making up the pivot shaft 3.3 are narrowed toward the exterior axially. The brackets 3.1 of the pivot mount 3 are provided with slots 6 for the ends of the pivot shaft 3.3.(see FIG. 2)

Figure 5:
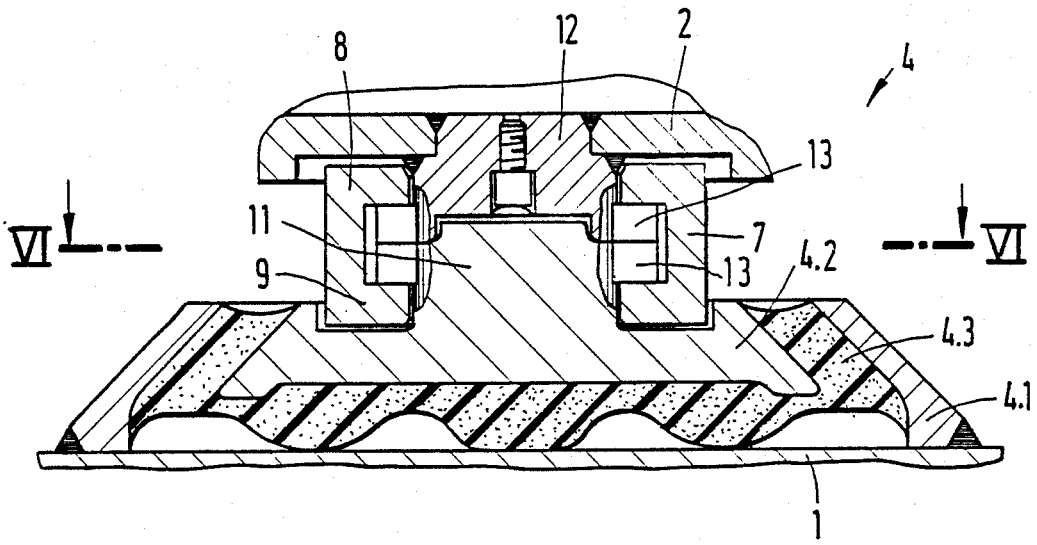
FIG. 5 is a cross sectional view through a retaining memver of the double layer armor plate member according to FIG. 1 taken along the section line V—V of GIG. 1.
Figure 6:
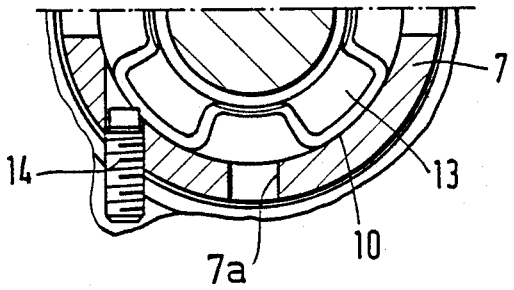
FIG. 6 is a cross sectional view through the retaining member of FIG. 5 taken along the line VI—VI of FIG. 5 showing the retaining member in a mounted condition.
Figure 7:
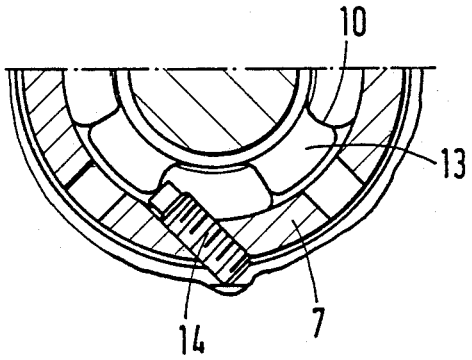
FIG. 7 is a cross sectional view through the retaining member of FIG. 5 taken along section line VI—VI of FIG. 5 showing the retaining member in a locked state.

The retaining member 4 shown in FIGS. 5 to 7 comprises a housing 4.1 rigidly attached to the inner armor plate member 1 and a core 4.2 attached detachably with the respective section 2 of the outer armor plate member as well as an elastic member 4.3 positioned between the housing 4.1 and the core 4.2. For detachable connection of the section 2 of the outer armor plate member and the core 4.2 of the elastic retaining member 4, a rotatable ring 7 is provided.

The ring 7 has an upper projecting edge 8 on its upper side directed inward and a lower projecting edge 9 directed inward on its lower side. The upper and lower projecting edges 8 and 9 are provided with radial recess 10 (see FIGS. 6 and 7). On a central protrusion 11 of the core 4.2 and on a central protrusion 12 of the section 2 aligned with it radial projections 13 corresponding to each other are found.

These projections are so dimensioned that they extend into the radial recesses 10 of the ring 7. By rotation of the ring 7 the central protrusions 11 and 12 are held together by a bayonet coupling. The holes 7*a* in the ring 7 permit a spanner to be inserted between the inner and outer plates to rotate the ring 7.

After the ring 7 is rotated into the locking configuration or state as shown in FIG. 7, it is secured by a locking screw 14 which prevents rotation.

We claim:

1. An armor for a structure to be protected against an impact projectile, the armor comprising:

an inner metallic armor plate mounted on said structure;

a first resilient mount and a second resilient mount spaced apart on said inner armor plate; and an outer metallic armor plate retained by said resilient mounts on said inner armor plate and forming one member of a plurality of such outer armor plates which are independent from one another and which collectively constitute an outer armoring for said structure, said first resilient mount including two pivotally interconnected and mutually detachable elements, one of said pivotally interconnected and mutually detachable elements being connected to said inner armor plate, the other of said pivotally interconnected and mutually detachable elements being connected to said outer armor plate so that it drops out of the one of said elements upon release of said second mount, and an elastic layer supporting the other element on the outer armor plate, the other element being out of direct contact with the outer armor plate, and said second resilient mount including a housing fixed to but separate from said inner armor plate, a core received with clearance in said housing, an elastic layer in said clearance in said housing between said housing and said core and supporting the core on the housing, the core being out of direct contact with the housing, the outer plates being supported exclusively by the elastic layers of the respective mounts on the inner plates, and means connecting said core detachably with said outer armor plate.

* * * * *